US005801347A

United States Patent [19]

Tsuge et al.

[11] Patent Number: 5,801,347

[45] Date of Patent: Sep. 1, 1998

[54] CORD SWITCH HAVING ALTERNATE INSULATING MEMBERS

[75] Inventors: Noboru Tsuge, Kariya; Takeshi Tanaka, Toyohashi, both of Japan

[73] Assignee: Asmo Co., Ltd., Kosai, Japan

[21] Appl. No.: 812,312

[22] Filed: Mar. 5, 1997

[30] Foreign Application Priority Data

Apr. 22, 1996 [JP] Japan ..... 8-100400

[51] Int. Cl.[6] ..... H01H 3/16

[52] U.S. Cl. ..... 200/61.44; 200/61.41

[58] Field of Search ..... 200/61.41–61.44, 200/85 R, 86 R; 49/26–28

[56] References Cited

U.S. PATENT DOCUMENTS

| | | | |
|---|---|---|---|
| 2,843,694 | 7/1958 | Bertaux | 200/86 |
| 4,532,388 | 7/1985 | Sackmann et al. | 200/61.43 |
| 4,742,196 | 5/1988 | Kelly | 200/86 R |
| 4,762,970 | 8/1988 | Brinsley | 200/86 R |
| 5,296,658 | 3/1994 | Kramer et al. | 200/61.43 |
| 5,459,962 | 10/1995 | Bonne et al. | 49/28 |

FOREIGN PATENT DOCUMENTS 7-96740 4/1995 Japan .

*Primary Examiner*—Michael L. Gellner
*Assistant Examiner*—Michael J. Hayes
*Attorney, Agent, or Firm*—Burns, Doane, Swecker & Mathis, LLP

[57] ABSTRACT

A cord switch includes an insulating tube, three conductive members respectively having a circular shape in cross-section and insulating members forming an insulating space therebetween. The three conductive members are disposed within the insulating tube in a triangular shape. The insulating members are formed slidably relative to the conductive members, and are disposed alternately in a longitudinal direction of the insulating tube. Thus, the three conductive members are bent by an approximately equal curvature, so that a compressive stress applied in a direction to reduce the insulating spaces formed between the conductive members becomes small, and therefore, the contact of the conductive members by bending can be prevented when the cord switch is attached at a bent portion of a window frame.

17 Claims, 6 Drawing Sheets

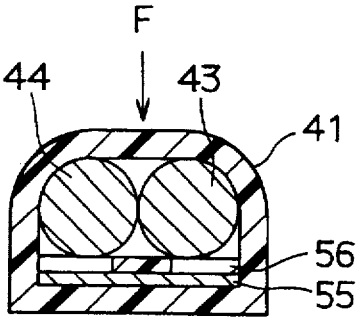
FIG. 9A
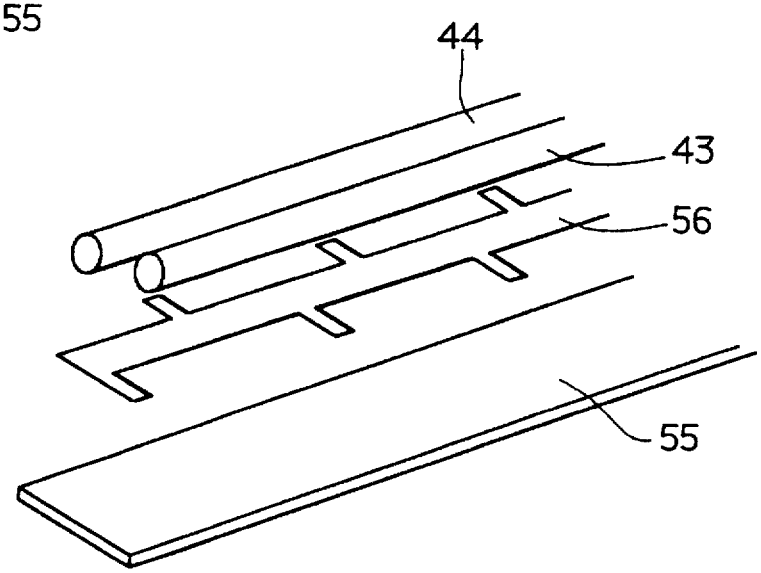
FIG. 9B
FIG. 10A
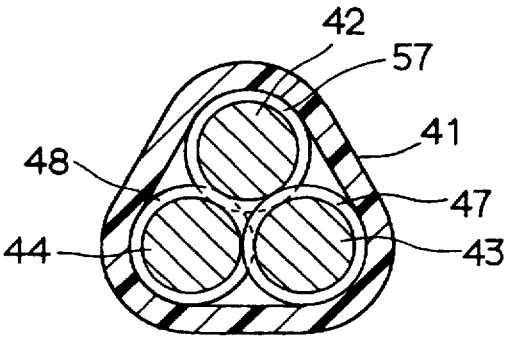
FIG. 10B
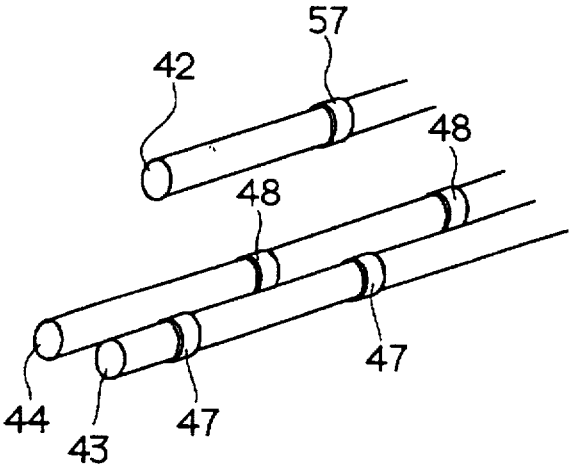

CORD SWITCH HAVING ALTERNATE INSULATING MEMBERS

CROSS REFERENCE TO RELATED APPLICATION

This application is related to and claims priority from Japanese Patent Application No. 8-100400 filed on Apr. 22, 1996, the contents of which are hereby incorporated by reference.

BACKGROUND OF THE INVENTION

1. Field of the Invention

The present invention relates to a cord switch which changes its conductive/nonconductive when a specified external force is applied in a direction crossing the longitudinal direction of the cord switch and, is suitably applied to an external force sensor for a vehicle door window frame for detecting an external force applied to the window frame.

2. Description of Related Art

In a conventional cord switch proposed in JP-A 7-96740, for example, a rubber elastic member is placed between a pair of conductive members facing each other to form a space therebetween and to fix the two conductive members in position. When an external force is applied to the conductive members, the elastic member is elastically deformed so that the pair of conductive members contact to become conductive. In the cord switch, although the conductive members can elastically deform, the elastic member mainly deforms when the external force is applied because the stiffness of the elastic member is smaller than that of the conductive members.

When the cord switch is attached to a vehicle door window frame, an erroneous operation is likely to occur in that, although no external force is applied to the cord switch by a foreign object, it becomes conductive. That is, the two conductive members are likely to contact each other at a bent or curved portion of the window frame.

A bending moment for integrally bending the conductive members and the elastic member is applied to the cord switch placed in a bent portion along the window frame. Therefore, when a bend R of the cord switch becomes small (i.e., the deflection of the cord switch is large), a bending stress is applied to the cord switch so that a compressive stress is remarkably increased in a direction to reduce the cross-section of the cord switch. Further, because the stiffness of the elastic member is smaller than that of the conductive member, the elastic member placed approximately on a neutral surface of a bend is reduced, and therefore, the two conductive members contact each other.

In the conventional cord switch, the external force necessary to contact the two conductive members greatly influences the elastic member. Therefore, when the rubber elastic member is used, the stiffness of the elastic member is changed with temperature so that a specified sensing level cannot be maintained. Generally, because the elastic member such as a silicon rubber having a small change in stiffness with temperature is expensive, the cost of the cord switch is increased.

SUMMARY OF THE INVENTION

In view of the foregoing problems, it is an object of the present invention to provide a cord switch which is free from an erroneous operation even when installed in a bent position such as a bending portion of a vehicle door window frame.

According to the present invention, a plurality of insulating members for a conductive member are disposed at every specified distance in the longitudinal direction of an insulating tube so that the conductive member is kept slidably relative to another conductive member. Further, when an external force is applied to the conductive members, the conductive member to which the external force is applied is elastically deformed to contact the other conductive member to become conducive. With the two conductive members being slidable each other, the two conductive members are separately and respectively bent by an approximately equal curvature when a bending moment is applied to the cord switch. Thus, a compressive stress applied in a direction to reduce the insulating space formed between the two conductive members becomes small, and therefore, the contact of the two conductive members by bending can be prevented when the cord switch is attached at a bent portion of a door window frame.

Preferably, the cord switch further includes a plurality of insulating members for a further conductive member disposed at every specified distance in the longitudinal direction of the insulating tube so that the further conductive member is kept slidably relative to other conductive member. Further, the conductive members have approximately equal shape in cross-section, and are so arranged that one of the conductive members is opposite to the other two conductive members in a triangular shape. When an external force is applied to the conductive members, at least one of the conductive members can contact the other conductive member. Because the conductive members are disposed in the triangular shape, a sensing area of the cord switch becomes large.

More preferably, the two sets of insulating members are alternately disposed in the longitudinal direction of the insulating tube. Therefore, for example, if one conductive member cannot contact another conductive member, the one conductive member can contact the other conductive member. Thus, the cord switch can suppress a dead section where an external force cannot be detected, and further accurately detects a pinched foreign object.

Alternatively, one of the conductive members is formed in a plate shape.

BRIEF DESCRIPTION OF THE DRAWINGS

Additional objects and advantages of the present invention will be more readily apparent from the following detailed description of preferred embodiments when taken together with the accompanying drawings, in which:

FIGS. 9A and 9B are a cross-sectional view and a disassembled perspective view showing the cord switch according to the eighth embodiment; and FIGS. 10A and 10B are a cross-sectional view and a disassembled perspective view showing the cord switch according to the ninth embodiment.

DETAILED DESCRIPTION OF THE PRESENTLY PREFERRED EMBODIMENT

Preferred embodiments of the present invention will be described hereinafter with reference to the accompanying drawings.

Figure 1A:
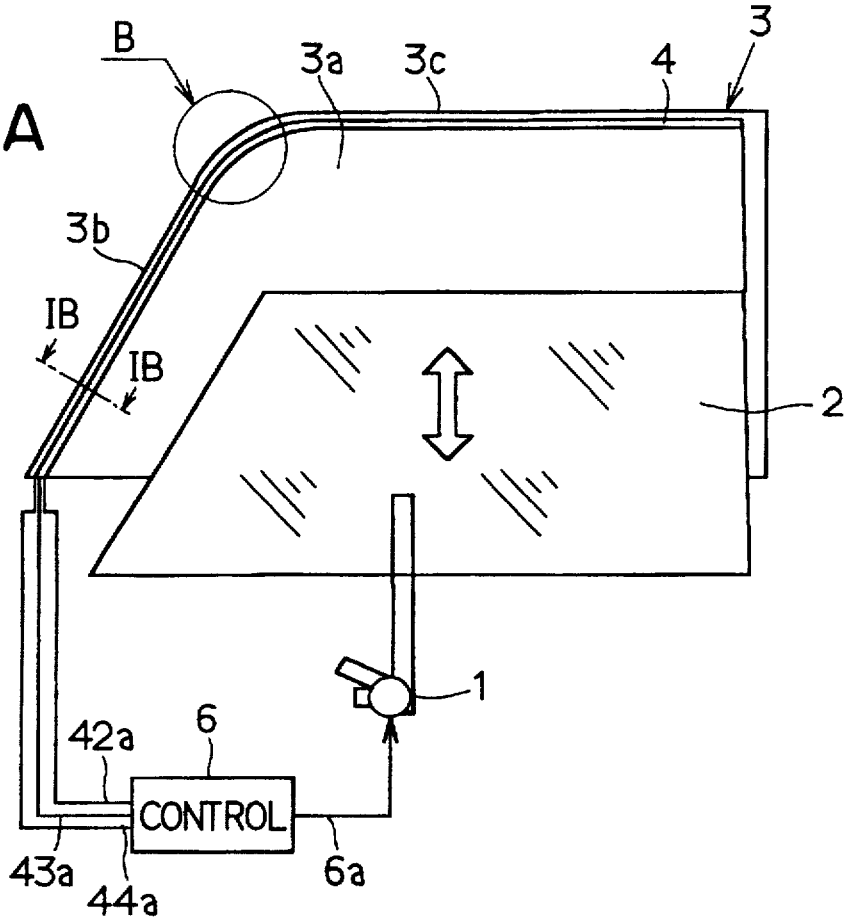
FIGS. 1A and 1B are schematic illustrations showing an assembled state of a cord switch according to the first embodiment of the present invention.
Figure 1B:
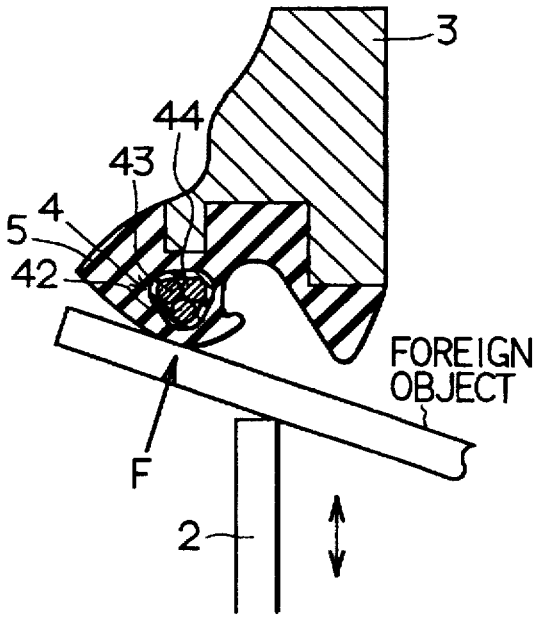

FIG. 1A shows a vehicle door having a catch prevention function which stops closing operation of a door window glass when a foreign object is caught between the door window frame and the window glass in a power window device for opening and closing (i.e., a power window function). As shown in FIGS. 1A and 1B, a window glass (window body) 2 for opening or closing a window opening 3*a* is fitted in a vehicle door to be moved up and down by a drive motor 1. Along a door window frame 3 framing the window opening 3*a* at a vehicle compartment side, a cord switch 4 for sensing an external force F applied by a foreign object is disposed along a front side portion 3*b* to an up side portion 3*c* of the window frame 3, and the cord switch 4 is inserted into a weather strip 5 sealing the clearance between the window glass 2 and the window frame 3.

Figure 2A:
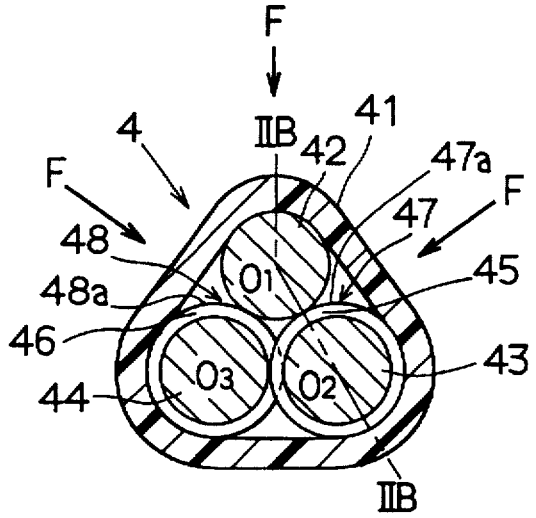
FIG. 2A is a cross-sectional view showing the cord switch according to the first embodiment of the present invention.

As shown in FIG. 2A (first embodiment), an insulating tube 41 is composed of resin or the like and is elastically deformable. Within the insulating tube 41, three elastically deformable conductive members 42–44 (i.e., first conductive member 42, second conductive member 43 and third conductive member 44) extending in the longitudinal direction of the insulating tube 41 are disposed. The conductive members 42–44 respectively have approximately similar circular shapes in cross-section. In the embodiment, the diameter of each conductive member 42–44 is in a range of 0.5–1.0 mm. The conductive members 42–44 extending in the longitudinal direction of the insulating tube 41 are disposed in a triangular shape so that one of the conductive members 42–44 is opposite to the other two conductive members. The material used for the conductive members 42–44 is a metal such as a stainless steel or phosphor bronze having a high fatigue limit.

Figure 2B:
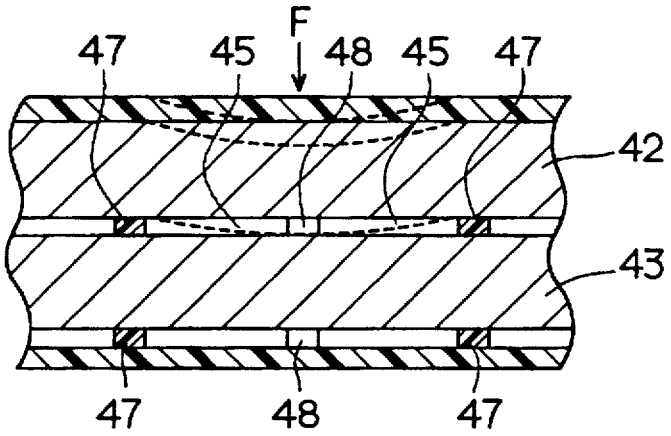
FIG. 2B is a cross-sectional view of the cord switch taken along the line IIB—IIB of FIG. 2A.
Figure 2C:
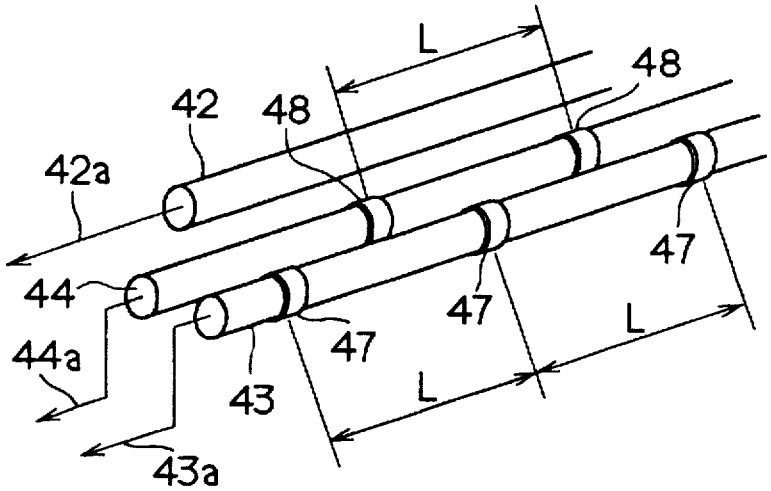
FIG. 2C is a disassembled perspective view showing conductive members of the cord switch.

As shown in FIGS. 2B and 2C, a plurality of ring-shaped insulating members 47 and 48 forming insulating spaces 45 and 46 between the conductive members 42–44 are fixed around the second and third conductive members 43 and 44, respectively, to cover a part of the outer surfaces of the two conductive members 43 and 44. Each of the first and second insulating members 47 and 48 is disposed slidably at a specified distance L from the adjacent insulating member in the longitudinal direction of the insulating tube 41. Further, each of the first insulating members 47 is disposed between the adjacent two of the second insulating members 48 in the longitudinal direction of the insulating tube 41.

The insulating members 47 and 48 are made of resin. Outside surfaces 47*a* and 48*a* of the insulating members 47 and 48 (i.e., the outside surface of the first insulating member 47 opposite to the first and third conductive members 42 and 44, and the outside surface of the second insulating member 48 opposite to the first and second conductive members 42 and 43) slidably contact the conductive member facing thereto. Therefore, the conductive members 42–44 are disposed slidably with each other. Thus, the conductive members 42–44 are separately and respectively bent by an approximately equal curvature when a bending moment is applied to the cord switch 4.

Electric wires 42*a*–44*a* are respectively connected to each end portion of the conductive members 42–44 in the longitudinal direction, and are connected to a control device 6 as shown in FIG. 1, and further, a specified electric voltage is applied between the first conductive member 42 and the second conductive member 43 and between the first conductive member 42 and the third conductive member 44.

When an external force F (FIG. 1B) is applied to the first conductive member 42, the first conductive member 42 is bent to contact the second conductive member 43 or the third conductive member 44 or both of the second and third conductive members 43 and 44 as shown by the broken line in FIG. 2B, and therefore, the cord switch 4 becomes conductive between the first conductive member 42 and the second conductive member 43 and/or the third conductive member 44. At this time, the control device 6 determines that a foreign object is caught between the window frame 3 and the window glass 2, and sends a signal 6*a* to the drive motor 1 for stopping the closing operation of the window glass 2.

According to the first embodiment of the present invention, because the conductive members 42–44 of the cord switch 4 are disposed slidably with each other, the conductive members 42–44 are separately and respectively bent by an approximately equal curvature when a bending moment is applied to the cord switch 4. Thus, a compressive stress applied in a direction to reduce the insulating spaces 45 and 46 formed between the conductive members 42–44 becomes small, and therefore, the contact of the conductive members 42–44 by bending can be prevented and an erroneous operation of the cord switch 4 can be prevented when the cord switch 4 is attached at the bent portion (B in FIG. 1A) of the window frame 3.

Because the compressive stress applied in a direction to reduce the insulating spaces 45 and 46 becomes small, the insulating members 47 and 48 are hardly deformed by bending. That is, the sensing level depends on the bending stiffness of the conductive members 42–44 and is hardly affected by the insulating members 47 and 48. Further, because the stiffness of a metal used for the conductive members 42–44 does not change so much with temperature change as compared with the rubber elastic member, a specified sensing level can be readily maintained in low cost irrespective of the temperature change.

Further, because a limit of the metal fatigue caused by repeated load is higher than a fatigue limit of the rubber elastic member, the durability of the cord switch 4 is improved.

Further, according to the first embodiment of the present invention, because the first conductive member 42 is bent and contacts the second conductive member 43 or the third conductive member 44 or both of the second and third conductive members 43 and 44 to sense the external force F, an area for contacting the first conductive member 42 and the second conductive member 43 or the third conductive member 44 or both of the second and third conductive members 43 and 44 (hereinafter referred to as sensing area)

is the total of an area for contacting the first conductive member 42 and the second conductive member 43 (hereinafter referred to as first sensing area) and an area for contacting the first conductive member 42 and the third conductive member 44 (hereinafter referred to as second sensing area).

Provided that the conductive members 42–44 are disposed to align on a single plane (centers $O_1$–$O_3$ of the conductive members 42–44 do not form a triangle), a coinciding area between the first sensing area and the second sensing area becomes large, and therefore, the total sensing area of the cord switch 4 becomes smaller than the total of the first sensing area and the second sensing area.

In the cord switch 4 of the first embodiment, on the contrary, because the conductive members 42–44 are disposed to form the triangular shape, the coinciding area between the first sensing area and the second sensing area becomes smaller. Thus, the sensing area of the cord switch 4 becomes large.

Provided further that the external force F is applied onto the two insulating members of the cord switch 4, that is, the positions of the conductive members 42–44 are reversed from that shown in FIG. 1B, the conductive members 42–44 may not be bent sufficiently, and therefore, the cord switch 4 cannot sense the external force F.

According to the cord switch 4 of the first embodiment, on the contrary, the first insulating members 47 and the second insulating members 48 are disposed respectively alternately in the longitudinal direction of the insulating tube 41. Therefore, for example, even if the first conductive member 42 cannot contact the second conductive member 43, the first conductive member 42 can contact the third conductive member 44 (the reverse case is also possible). Thus, the cord switch 4 of the first embodiment can suppress a dead section where the external force F cannot be detected, and further accurately detects a pinched foreign object.

In the first embodiment, the electric voltage applied between the first conductive member 42 and the second conductive member 43 is equal to the electric voltage applied between the first conductive member 42 and the third conductive member 44. However, the applied electric voltages of the conductive members 42–44 may be different from each other. In this case, even when the second conductive member 43 and the third conductive member 44 contact, the cord switch 4 becomes conductive, and therefore, the cord switch can sense the external force F applied in a direction defined by the centers $O_2$ and $O_3$ of the second and third conductive members 43 and 44 by the use of voltage difference. Thus, the sensing area can be further increased.

In order to simplify the assembling work of the two insulating members 47 and 48 in a step for manufacturing the cord switch 4, the first embodiment may be modified as described hereinafter. That is, various insulating members are used instead of the two ring-shaped insulating members 47 and 48 in the first embodiment.

Figure 3A:
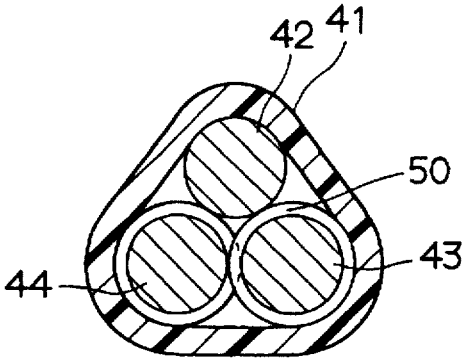
FIG. 3A is a cross-sectional view and FIGS. 3B and 3C are disassembled perspective views showing the cord switch according to the second embodiment.
Figure 3B:
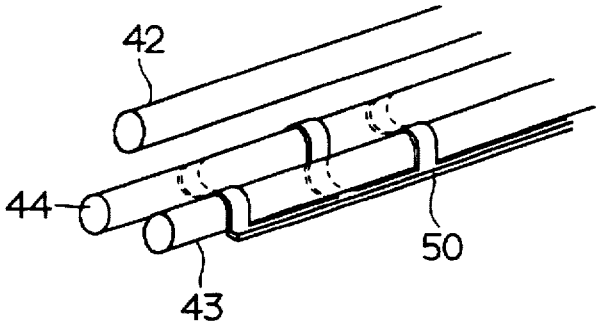
Figure 3C:
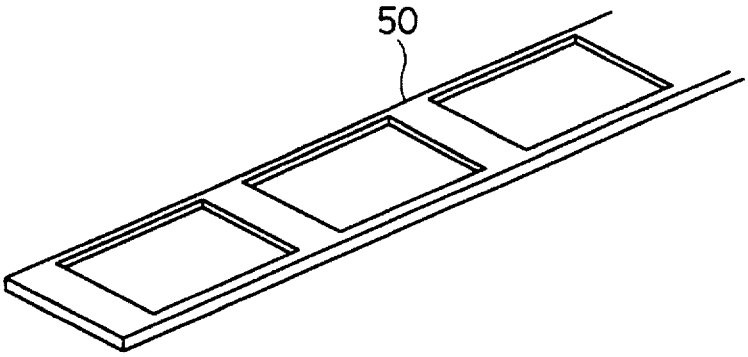

As shown in FIGS. 3A–3C (second embodiment), the two insulating members 47 and 48 are integrated by a ladder-shaped insulating member 50 having rectangular openings. Positions where the insulating member 50 contacts both of the first conductive member 42 and second conductive member 43 and positions where the insulating member 50 contacts both of the first conductive member 42 and third conductive member 44 are alternately disposed in the longitudinal direction of the first conductive member 42.

Figure 4A:
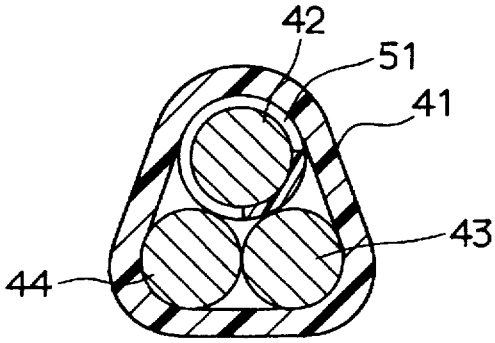
FIGS. 4A and 4B are a cross-sectional view and a disassembled perspective view showing the cord switch according to the third embodiment.
Figure 4B:
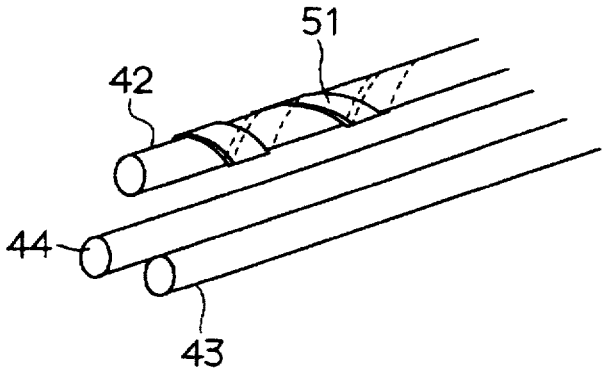

As shown in FIGS. 4A and 4B (third embodiment), a strip-shaped insulating member 51 is spirally wound only around the first conductive member 42.

Figure 5A:
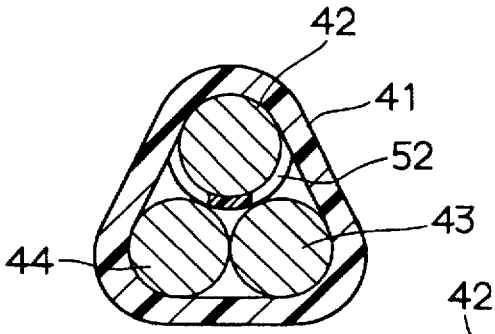
FIGS. 5A and 5B are a cross-sectional view and a disassembled perspective view showing the cord switch according to the fourth embodiment.
Figure 5B:
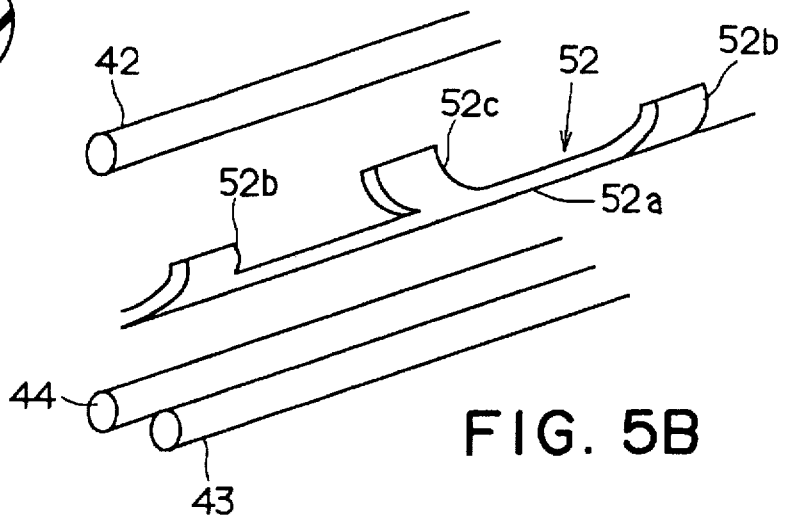

As shown in FIGS. 5A and 5B (fourth embodiment), an insulating member 52 is disposed between the first conductive member 42 and the second and third conductive members 43 and 44. The insulating member 52 has a trunk portion **52*a* extending in the longitudinal direction of the first conductive member 42, branch portions 52*b* extending from the trunk portion 52*a* to the side of the second conductive member 43, and branch portions 52*c* extending from the trunk portion 52*a* to the side of the third conductive member 44. The trunk portion 52*a* of the insulating member 52 contacts the first conductive member 42 and the second and third conductive members 43 and 44. Further, the branch portions 52*b* and the branch portions 52*c* are alternately disposed in the longitudinal direction of the first conductive member 42**.

Figure 6A:
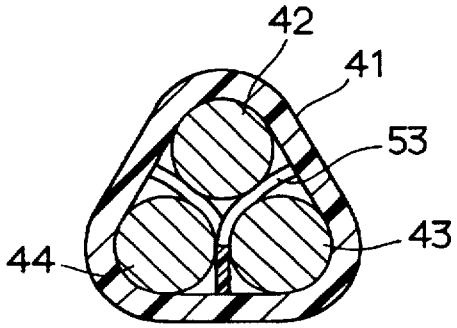
FIGS. 6A and 6B are a cross-sectional view and a disassembled perspective view showing the cord switch according to the fifth embodiment.
Figure 6B:
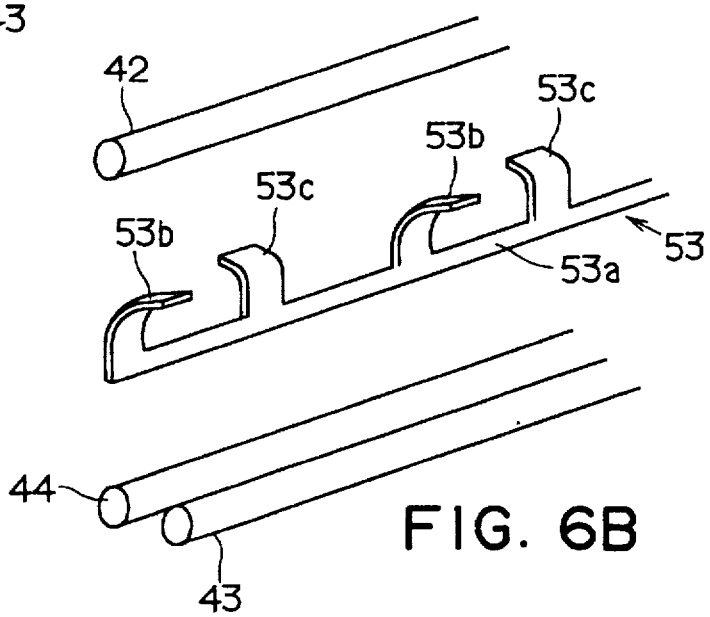

As shown in FIGS. 6A and 6B (fifth embodiment), an insulating member 53 is disposed between the first conductive member 42 and the second and third conductive members 43 and 44. The insulating member 53 has a trunk portion **53*a* extending in the longitudinal direction of the first conductive member 42, branch portions 53*b* bent from the trunk portion 53*a* to the side of the second conductive member 43, and branch portions 53*c* bent from the trunk portion 53*a* to the side of the third conductive member 44. The trunk portion 53*a* is inserted between the second and third conductive members 43 and 44. Further, the branch portions 53*b* and the branch portions 53*c* are alternately disposed in the longitudinal direction of the first conductive member 42**.

Figure 7A:
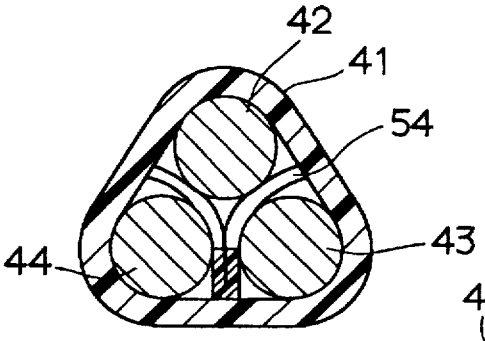
FIGS. 7A and 7B are a cross-sectional view and a disassembled perspective view showing the cord switch according to the sixth embodiment.
Figure 7B:
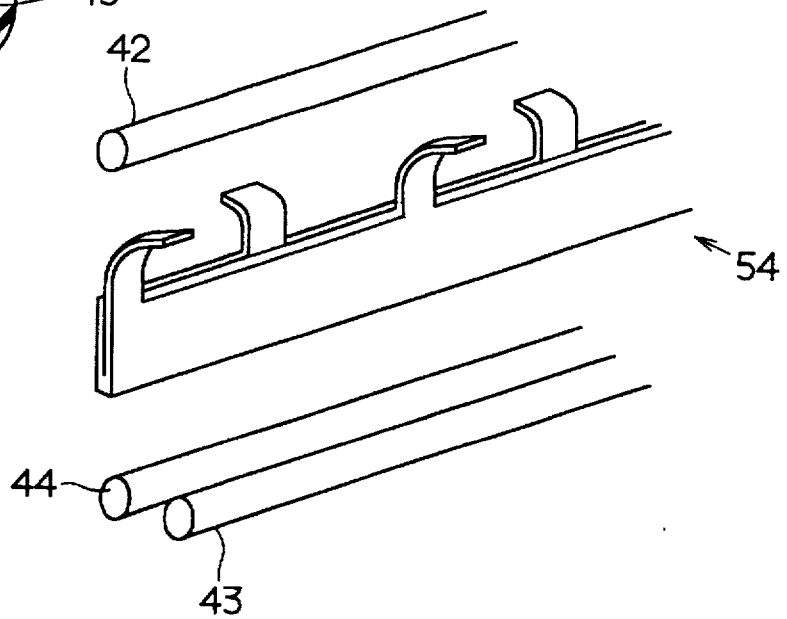

Further, as shown in FIGS. 7A and 7B (sixth embodiment), an insulating board 54 having alternately formed branch portions at two length sides are folded along the longitudinal center line of the insulating board 54, so that the insulating member similar to the shape of the insulating member 53 shown in FIGS. 6A and 6B are formed. The insulating member 54 is disposed between the first conductive member 42 and the second and third conductive members 43 and 44.

In the foregoing embodiments, the conductive members 42–44 are disposed to form a triangular shape. If the stiffness of the insulating tube 41 is low, when the external force F is applied to the first conductive member 42 perpendicularly to the line direction connecting the centers $O_2$ and $O_3$ of the second and third conductive members 43 and 44, it is likely that the first conductive member 42 does not bend within the insulating tube 41 but moves into a space between the second conductive member 43 and the third conductive member 44 which move laterally from each other. Thus, although the external force F is applied, the first conductive member 42 does not contact the second and third conductive member 43 and 44, so that the cord switch 4 can not sense the external force F.

Figure 8A:
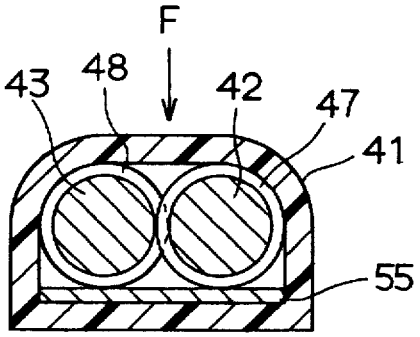
FIGS. 8A and 8B are a cross-sectional view and a disassembled perspective view showing the cord switch according to the seventh embodiment.
Figure 8B:
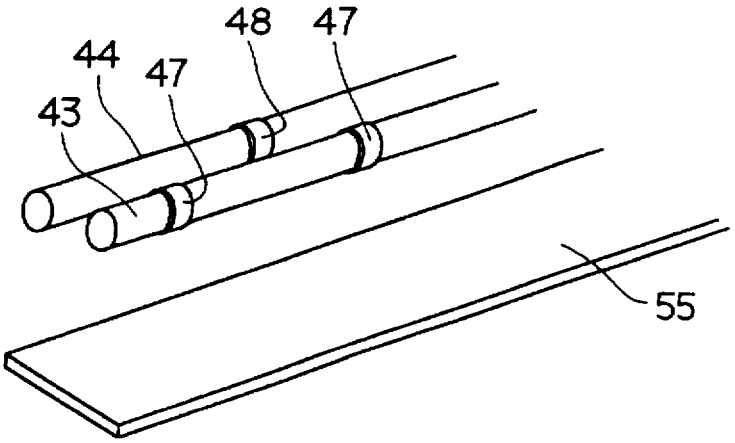

In view of this, in FIGS. 8A and 8B (seventh embodiment), a flat conductive member 55 is used as the first conductive member. Further, as shown in FIGS. 9A and 9B (eighth embodiment), an insulating member 56 having a shape similar to the insulating member 52 in FIG. 5B is disposed between the flat first conductive member 55 and the second and third conductive members 43 and 44.

When the cord switch 4 according to the seventh and eighth embodiments is attached in the window frame 3, it is preferable that the second and third conductive members 43 and 44 are disposed toward a side to which the external force F is applied (i.e., the side of opening the window glass).

According to the cord switch 4 shown in FIGS. 8A and 8B and FIGS. 9A and 9B, because the first conductive member 55 does not move into a space between the second and third conductive members 43 and 44. Thus, the external force F can be accurately detected.

Further, as shown in FIGS. 10A and 10B (ninth embodiment), insulating members 47, 48 and 57 may be respectively formed on the conductive members 42–44.

Further the insulating tube 41 may be replaced by the whether strip 5.

The present invention having been described hereinabove should not be limited to the disclosed embodiments but may be implemented in other ways without departing from the scope and spirit of the present invention.

What is claimed is:

1. A cord switch comprising:

an elastically deformable insulating tube; elastically deformable first and second conductive members disposed within said insulating tube and extending in a longitudinal direction of said insulating tube, said first and second conductive members having circular cross-sectional shapes; and a plurality of first insulating members disposed with a predetermined distance between adjacent first insulating members in said longitudinal direction of said insulating tube to form insulating spaces between said first and second conductive members, wherein:

said first insulating members are disposed slidably relative to at least one of said first and second conductive members; and said first and second conductive members are arranged to deform elastically to contact each other when an external force is applied thereto.

2. A cord switch comprising:

an elastically deformable insulating tube;

elastically deformable first and second conductive members disposed within said insulating tube and extending in a longitudinal direction of said insulating tube;

a plurality of first insulating members disposed with a predetermined distance between adjacent first insulating members in said longitudinal direction of said insulating tube to form insulating spaces between said first and second conductive members;

an elastically deformable third conductive member disposed within said insulating tube and extending in said longitudinal direction of said insulating tube; and a plurality of second insulating members disposed with a predetermined distance between adjacent second insulating members in said longitudinal direction of said insulating tube to form insulating spaces between said first and third conductive members, wherein:

said first insulating members are disposed slidably relative to at least one of said first and second conductive members;

said first and second conductive members are arranged to deform elastically to contact each other when an external force is applied thereto;

said second insulating members are disposed slidably relative to at least one of said first and third conductive members;

said conductive members have approximately equal shapes in cross-section and are so arranged that one of said conductive members is opposite to the other two conductive members to form a triangular shape; and said conductive members are arranged to deform elastically to provide contact between said first conductive member and at least one of said second and third conductive members when an external force is applied thereto.

3. A cord switch according to claim 2, wherein:

each of said first insulating members is arranged between longitudinally adjacent two of said second insulating members.

4. A cord switch according to claim 3, wherein:

said conductive members have approximately equal circular shape in cross-section.

5. A cord switch according to claim 4, wherein:

said first insulating members are in a ring shape formed on said second conductive member to cover only a part of said second conductive member; and said second insulating members are in a ring shape formed on said third conductive member to cover only a part of said third conductive member.

6. A cord switch according to claim 3, wherein:

said first insulating members and said second insulating members are formed integrally in a ladder-shape.

7. A cord switch comprising:

an elastically deformable insulating tube;

elastically deformable first and second conductive members disposed within said insulating tube and extending in a longitudinal direction of said insulating tube; and a plurality of first insulating members disposed with a predetermined distance between adjacent first insulating members in said longitudinal direction of said insulating tube to form insulating spaces between said first and second conductive members, said first insulating members being formed by a strip-shaped insulating member spirally wound around said first conductive member, wherein:

said first insulating members are disposed slidably relative to at least one of said first and second conductive members; and said first and second conductive members are arranged to deform elastically to contact each other when an external force is applied thereto.

8. A cord switch according to claim 2, wherein:

said first and second insulating members are formed by an integral insulating member disposed between said first conductive member and said second and third conductive members;

said integral insulating member has a trunk portion disposed on said second and third conductive members and extending in said longitudinal direction of said insulating tube, first branch portions extending from said trunk portion to the side of said second conductive member and second branch portions extending from said trunk portion to the side of said third conductive member; and said first branch portions and second branch portions are alternately disposed in said longitudinal direction of said insulating tube.

9. A cord switch according to claim 2, wherein:

said first and second insulating members are formed by an integral insulating member which is disposed between said first conductive member and said second and third conductive members;

said integral insulating member has a trunk portion inserted between said second conductive member and said third conductive member and extending in said longitudinal direction of said insulating tube, first branch portions bent from said trunk portion to the side of said second conductive member and second branch portions bent from said trunk portion to the side of said third conductive member; and said first branch portions and second branch portions are alternately disposed in said longitudinal direction of said insulating tube.

10. A cord switch according to claim 9, wherein said integral insulating member is formed by folding an elongated insulating board having alternately formed branch portions along a longitudinal center line of said insulating board.

11. A cord switch according to claim 2, wherein:

said insulating tube is attached in a vehicle door window frame; and said first conductive member is disposed to face a window glass in said window frame.

12. A cord switch comprising:

an elastically deformable insulating tube;

elastically deformable first and second conductive members disposed within said insulating tube and extending in a longitudinal direction of said insulating tube, said first conductive member being shaped flat and said second conductive member being shaped circularly in cross-section; and a plurality of first insulating members disposed with a predetermined distance between adjacent first insulating members in said longitudinal direction of said insulating tube to form insulating spaces between said first and second conductive members, wherein:

said first insulating members are disposed slidably relative to at least one of said first and second conductive members; and said first and second conductive members are arranged to deform elastically to contact each other when an external force is applied thereto.

13. A cord switch comprising:

an elastically deformable insulating tube;

an elastically deformable first conductive member having a flat shape, disposed within said insulating tube and extending in a longitudinal direction of said insulating tube;

elastically deformable second and third conductive members respectively having a circular shape in cross-section, disposed within said insulating tube and extending in a longitudinal direction of said insulating tube;

a plurality of first insulating members disposed at spaced apart distances in said longitudinal direction of said insulating tube to form insulating spaces between said first and second conductive members; and a plurality of second insulating members disposed at spaced apart distances in said longitudinal direction of said insulating tube and to form insulating spaces between said first and third conductive members, wherein:

said first insulating members are disposed slidably relative to at least one of said first and second conductive members;

said second insulating members are disposed slidably relative to at least one of said first and third conductive members;

said conductive members are arranged to deform elastically to provide contact between said first conductive member and at least one of said second and third conductive members when an external force is applied thereto.

14. A cord switch according to claim 13, wherein:

each of said first insulating members is arranged between longitudinally adjacent two of said second insulating members.

15. A cord switch according to claim 14, wherein:

said first and second insulating members are respectively formed on surfaces of said second and third conductive members to cover only a part of said second and third conductive members.

16. A cord switch according to claim 13, wherein:

said first and second insulating members are formed by an integral insulating member disposed between said first conductive member and said second and third conductive members;

said integral insulating member has a trunk portion extending in said longitudinal direction of said insulating tube, first branch portions extending from said trunk portion to the side of said second conductive member and second branch portions extending from said trunk portion to the side of said third conductive member; and said first branch portions and second branch portions are alternately disposed in said longitudinal direction of said insulating tube.

17. A cord switch according to claim 13, wherein:

said insulating tube is attached in a vehicle door window frame; and said second and third conductive members are disposed to face a window glass in said window frame.

* * * * *